US005096105A

United States Patent [19]

Proctor

[11] Patent Number: 5,096,105

[45] Date of Patent: Mar. 17, 1992

[54] MAIL PROTECTION DEVICE

[76] Inventor: Mitchell L. Proctor, 353 NW. Lorna, Burleson, Tex. 76028

[21] Appl. No.: 672,219

[22] Filed: Mar. 20, 1991

[51] Int. Cl.[5] ..... A45C 11/00; A41D 19/00

[52] U.S. Cl. ..... 224/218; 224/217

[58] Field of Search ..... 224/218, 217, 247, 906, 224/907; 2/16, 160; D3/100

[56] References Cited

U.S. PATENT DOCUMENTS

| | | | |
|---|---|---|---|
| 2,432,325 | 12/1947 | McDougall | 2/160 |
| 3,570,009 | 3/1971 | Spruell | 2/16 |
| 3,806,952 | 4/1974 | Viciulis | 2/16 |
| 4,578,823 | 4/1986 | Hudson, Jr. | 2/16 |
| 4,807,302 | 2/1989 | Cannella | 2/16 |
| 4,813,082 | 3/1989 | Kallman | 2/160 X |
| 4,919,037 | 4/1990 | Mitchell | 224/218 X |

FOREIGN PATENT DOCUMENTS

| | | | |
|---|---|---|---|
| 14922 | 10/1888 | United Kingdom | 224/218 |

*Primary Examiner*—Henry J. Recla
*Assistant Examiner*—David J. Walczak
*Attorney, Agent, or Firm*—Henderson & Sturm

[57] ABSTRACT

A mail protecting device (10) for covering a bundle of mail (200) from inclement weather during delivery; wherein, the device (10) includes a relatively stiff cover member (13) having a roof portion (14) and at least one side wall portion (15) for protecting a bundle of mail (200) plus a hand grip unit (12) for permitting the user to grasp both the cover member (13) and the bundle of mail (200).

3 Claims, 1 Drawing Sheet

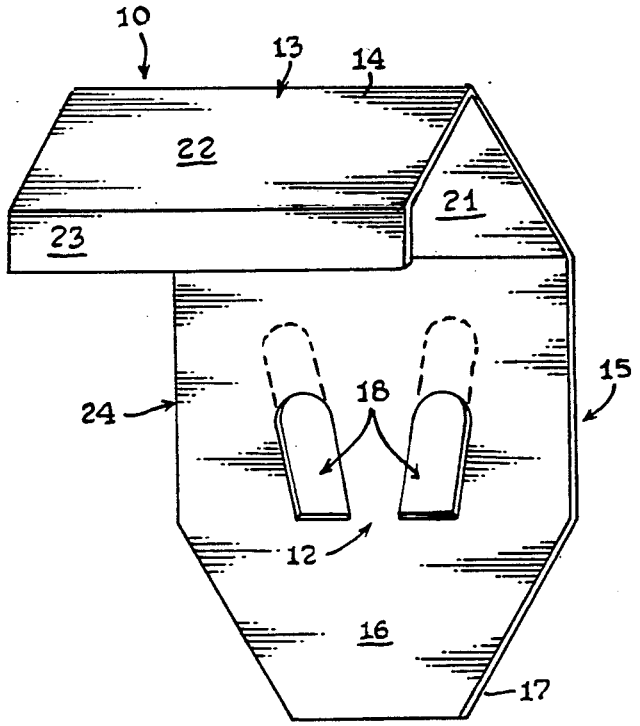
FIG. 1.
FIG. 2.
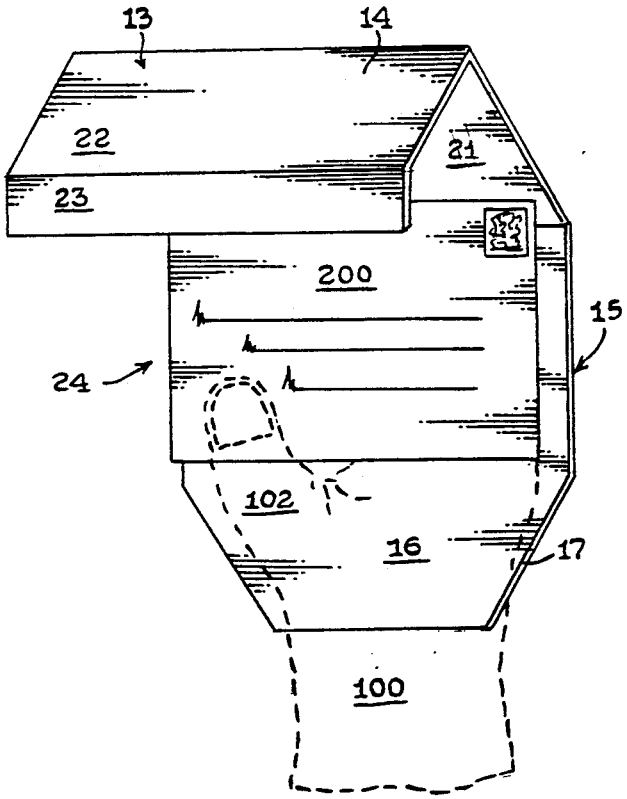
FIG. 3.
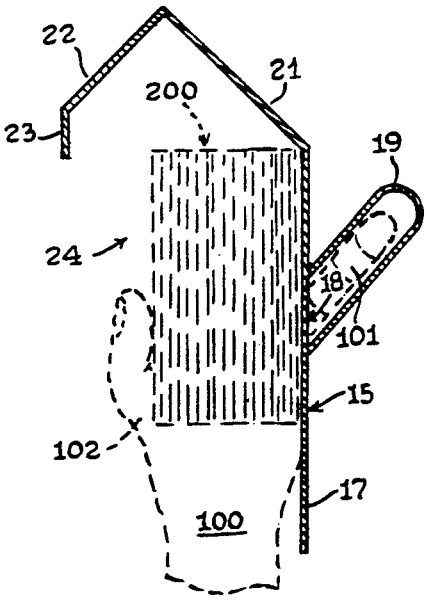

MAIL PROTECTION DEVICE

TECHNICAL FIELD

The present invention relates to the field of protective devices in general; and, in particular to a device for protecting mail from inclement weather.

BACKGROUND ART

This invention was the subject matter of Document Disclosure Program Registration No. 258932 which was filed in the United States Patent and Trademark Office on July 31, 1990.

As can be seen by reference to the following U.S. Pat. Nos. 3,570,009; 4,807,302; 3,806,952; and 4,578,823; the prior art is replete with myriad and diverse Hand Protecting Devices.

While all of the aforementioned prior art constructions are more than adequate for the basic purpose and function for which they have been specifically designed, these prior art constructions are uniformly deficient in that they are unable to be used to protect small hand-held items, such as letters, from damage due to precipitation. As most mail carriers are aware there has been a longstanding problem with keeping mail dry while delivering it during rain or snow storms. Furthermore there has been no known solution to this problem until the development of the present invention.

As a consequence of the foregoing situation, there has existed a longstanding need for an apparatus that may be used to protect mail from precipitation, while neither being bulky nor burdensome for the courier to use; and, the provision of such a construction is a stated objective of the present invention.

DISCLOSURE OF THE INVENTION

Briefly stated, this invention comprises a small protection device designed to prevent precipitation damage often incurred during postal delivery. The apparatus comprises a hand-held shield unit constructed of a water impermeable material; such as plastic or the like provided with a plurality of finger grip units to facilitate the grasping of both the device and a bundle of mail.

As will be explained in greater detail further on in the specification, the mail protection device is designed to cover and protect both the mail carriers hand and a bundle of mail grasped by the covered hand such that precipitation will be prevented from coming into contact with the mail as it is being transferred from the mail carriers pouch to the recipients mail receptacle.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an isolated perspective view of the mail protecting device.

FIG. 2 is a similar perspective view to that of FIG. 1, also depicting the mail carriers hand and a bundle of mail; and, FIG. 3 is a cross-sectional side plan view of the device.

BEST MODE FOR CARRYING OUT THE INVENTION

As can be seen by reference to the drawings and in particular to FIG. 1, the mail protecting device that forms the basis of the present invention is designated generally by the reference numeral (10). The device (10) comprises in general a shielding unit (11) and a hand grip unit (12). These units will now be described in seriatim fashion.

As shown in FIGS. 1 and 3, the shielding unit (11) comprises in general an inverted generally J-shaped and relatively stiff cover member (13) having a roof portion (14) and side wall portion (15) which depends downwardly from one end of the roof portion (14).

In addition the side wall portion (15) further comprises a generally elongated side wall member (16) having: an upper end which is secured to the roof portion (14); a lower end (17) which is tapered; and, a plurality of finger apertures (18) which are formed proximate the midpoint of the side wall member (16) and dimensioned to receive the fingers (101) of the mail carriers hand (100).

As can also be seen particularly by reference to FIG. 3, each of the apertures (18) is in open communication with a finger sleeve element (19) which projects upwardly and outwardly relative to the side wall member (16); wherein, the carriers fingers (101) are protected from the elements.

In the preferred embodiment of the invention depicted in FIGS. 1 through 3, the roof portion (14) comprises panel segments (21) and (22) forming a peaked roof configuration; wherein, the outboard panel segment (22) is further provided with a downwardly depending lip element (23) which serves to prevent rain, mist, or snow from entering the open side (24) of the device (10). However it should also be noted that any suitable type of roof configuration can be substituted for the peaked roof configuration depicted in the drawings, such as an L or C-shaped configuration; as long as the roof member (13) substantially covers the top of the mail carriers hand.

It should further be noted that the finger apertures (18) and the sleeve elements (19) comprise the preferred hand grip unit (12) of the device (10); however other suitable hand grip means may be substituted therefore; as long as the mail carriers fingers (101) remain covered as they grasp the device (10) while the carriers thumb captively engages the bundle of mail (200) against the interior of the device (10) and/or the users fingers (101).

In this manner the device (10) provides an efficient means for transferring a bundle of mail (200) from the mail carriers pouch to the recipients mail receptacle while protecting the bundle of mail from the elements.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A mail protecting device for covering a bundle of mail during inclement weather to be worn by a user; wherein, the device comprises:

a shielding unit including a relatively stiff generally inverted J-shaped cover member having a roof portion and at least one side wall portion; and, finger grip means associated with said at least one side wall portion; wherein, said grip means comprise at least one aperture formed in said at least one side wall portion, and dimensioned to receive at least one of the users fingers; wherein, the at least one finger will form an operative engagement between the users hand and the device; whereby, the bundle of mail may be supported under the roof portion by being grasped between the users thumb and any of the users other fingers which are not forming an operative engagement with the device.

2. The device as in claim 1; wherein, said at least one aperture is further provided with a sleeve element that projects upwardly and outwardly relative to said at least one side wall portion.

3. The device as in claim 1; wherein, said roof portion is further provided with a downwardly depending lip element.

* * * * *